United States Patent [19]

Stoy et al.

[11] Patent Number: 4,996,858

[45] Date of Patent: Mar. 5, 1991

[54] APPARATUS FOR HYDROSTATIC BRACING OF A ROLL IN A ROLLING MILL

[75] Inventors: Erich Stoy, Ratingen; Hans Römmen, Dormagen; Dieter Rumpf, Hilden, all of Fed. Rep. of Germany

[73] Assignee: SMS Schloemann-Siemag Aktiengesellschaft, Dusseldorf, Fed. Rep. of Germany

[21] Appl. No.: 336,232

[22] Filed: Apr. 11, 1989

[30] Foreign Application Priority Data

Apr. 11, 1988 [DE] Fed. Rep. of Germany ..... 3811952

[51] Int. Cl.[5] ..... B21B 27/10

[52] U.S. Cl. ..... 72/43; 72/201; 72/236

[58] Field of Search ..... 72/236, 201, 245, 43–45

[56] References Cited

U.S. PATENT DOCUMENTS

| | | | |
|---|---|---|---|
| 3,540,527 | 11/1970 | Gremfell et al. | 72/201 |
| 4,212,504 | 7/1980 | Krylov et al. | 72/245 |
| 4,638,654 | 1/1987 | Lubrano | 72/236 |
| 4,741,193 | 5/1988 | Kimura et al. | 72/236 |

FOREIGN PATENT DOCUMENTS

| | | | |
|---|---|---|---|
| 1811764 | 7/1970 | Fed. Rep. of Germany . | |
| 2507234 | 8/1976 | Fed. Rep. of Germany . | |
| 2651028 | 8/1985 | Fed. Rep. of Germany . | |
| 1349699 | 12/1963 | France | 72/245 |
| 1445170 | 5/1966 | France . | |
| 57-68208 | 10/1980 | Japan . | |
| 58-41606 | 9/1981 | Japan . | |
| 62-40913 | 8/1985 | Japan . | |
| 45409 | 2/1987 | Japan | 72/201 |
| 6412232 | 4/1966 | Netherlands | 72/245 |

*Primary Examiner*—Daniel C. Crane
*Attorney, Agent, or Firm*—Herbert Dubno

[57] ABSTRACT

The apparatus for support of a roll in a rolling mill comprises a single supporting member having a longitudinally-extending elliptically-cross sectioned shell-like cavity extending over the entire length of the roll and engaging the roll so it rests in the shell-like cavity and a plurality of crescent-shaped plastic blocking pieces spaced from each other transversely along the supporting member in the shell-like cavity to divide it into a plurality of pressurized chambers to which a plurality of pressurized medium lines are connected. Each of the blocking pieces are provided with a plurality of openings for a lubricant and can be provided with compression springs to urge the blocking piece toward the roll.

6 Claims, 5 Drawing Sheets

APPARATUS FOR HYDROSTATIC BRACING OF A ROLL IN A ROLLING MILL

FIELD OF THE INVENTION

Our present invention relates to an apparatus for hydrostatic bracing of a roll in a rolling mill, especially a working roll of a two high, four-high, six-high or other steel rolling mill.

BACKGROUND OF THE INVENTION

The bracing apparatus described in German patent 26 51 028 for support of a roll over the length of its working surface has several supporting members distributed longitudinally, which are provided with shell-like bearing pockets on their surfaces facing or adjacent the surface of the roll being supported which are connected to pressurized medium lines.

The pressurized medium fed to the bearing pockets of the supporting members by the pressurized medium lines is fed via control valves with mechanical sensors, which are mounted at both ends of the supported roll and which detect the position of the ends of the roll.

As soon as the roll moves from its set position in one or the other direction, the pressure of the pressurized medium in the pressurized medium lines is reduced by the control valves and thus the roll is brought back to its original set point position.

This known roll bracing apparatus has the disadvantage that the supporting members spaced adjacent each other allow only a minimal use of the available supporting surface. The degree of roll bracing is correspondingly comparatively small and can be adjusted to the requirements only by excessive pump pressure. This of course involves a comparatively high energy consumption and is expensive.

Furthermore the flow of the pressurized medium depends on the load experienced by the working roll during operation, which requires a special variable pump control. The pressurized medium flow, continuously changing in its value depending on the load experienced by the working roll, disadvantageously affects the cooling of the rolls. Finally in this known roll bracing apparatus on both ends of the roll control valves with mechanical sensors reducing the roll bracing surfaces are required to hold the roll in its preset working position.

OBJECTS OF THE INVENTION

An object of our invention is to provide an improved roll bracing device which overcomes the aforedescribed drawbacks.

It is an object of our invention to provide a hydrostatic roll bracing apparatus, which avoids the abovementioned disadvantages, especially allowing optimum use of the available supporting surfaces in a simple and particularly economical way.

SUMMARY OF THE INVENTION

These objects and others which will become more readily apparent hereinafter are attained, in accordance with our invention, in a supporting apparatus for individual rolls, especially the working rolls, in a rolling mill.

According to our invention only a single bracing or supporting member is provided for each of at least two rolls of the mill.

The bracing member extends over the entire length of the respective roll and has a shell-like cavity open toward the roll, the cavity advantageously having an elliptical-segment cross section.

A plurality of blocking pieces or partitions spaced from one another in the longitudinal direction of the bracing member are mounted in the shell-like cavity of the supporting member.

These partitions divide the shell-like cavity into a plurality of pressurized chambers to which pressurized medium lines are connected. Because only a single bracing member extending over the entire length of each roll is provided in our invention, the entire available supporting surface can be utilized and a sufficiently higher roll pressure over the entire length of the roll can be produced and maintained so that pump pressure and energy expenses are reduced for a constant pressurized medium flow.

The elliptical cavity of the supporting member allows an advantageous pressurized medium cushion between the roll surface and the supporting member to be formed which, with satisfactory pressure conditions, allows maintaining of a sufficiently large gap width between the roll surface and the outer edges of the supporting member for escape of the pressurized medium so that hydraulic centering devices can be eliminated.

In addition the elliptical-segment-shaped cavity of the supporting member allows matching of the supporting member to rolls with different roll diameters.

Further the elliptical-segment-shaped cavity according to our invention are divided into the plurality of chambers by the partitions, to which chambers the pressurized medium lines are connected. Each of the chambers can be pressurized individually to different pressures. Consequently the supporting apparatus operation can be optimized and matched to loads varying across the length of the roll. Besides, according to our invention, neither helping devices nor pressurized medium regulators are required, since the pressurized medium flow rate can be maintained constant. Also according to our invention an intensive comparatively strong cooling of the rolls occurs because of the structure and design of the supporting member.

In one embodiment of our invention the partitions are each made from a crescent-moon shaped piece of elastic material, especially plastic. This material is characterized by minimal frictional resistance and a good sealing action. By "plastic" here we mean all nonmetallic modern combinations of materials, especially fiber-reinforced synthetic resins, which is especially advantageously used in this type of application.

To keep the friction between the surface of the roll and the partitions as small as possible, in another embodiment, the partitions are provided with openings for feeding lubricant in the region between the roll surface and the partitions. The service life of the partitions is substantially raised in this way and the lubricant can function simultaneously as a pressurizing and interchamber flow-blocking medium.

According to another feature of our invention the blocking piece can be combined with a compression spring which urges it forward. With the help of this compression spring the blocking piece is pressed tightly to the surface of the working roll and held in position so that no pressurized medium can reach the neighboring pressurized chamber.

In a particularly advantageous embodiment of our invention the blocking pieces are oriented in the shell-like cavity at an angle of about 45° to the longitudinal axis of the roll and several ducts, each with a nozzle, connected to the pressurized medium line are provided in the supporting member. This inclined orientation of the blocking member and the nozzles in the supporting member is advantageously characterized by a particularly good pressurized medium distribution in the chambers and by a satisfactory roll surface protection action.

According to another advantageous feature of our invention the supporting member is provided with three ducts with nozzles in a plane, a center duct being substantially perpendicular to the roll surface while the outer two ducts are inclined to the surface of the roll. Thus in the vicinity of the supporting element a pressure can be maintained on the roll which is uniform over the entire roll surface and has a centering effect.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
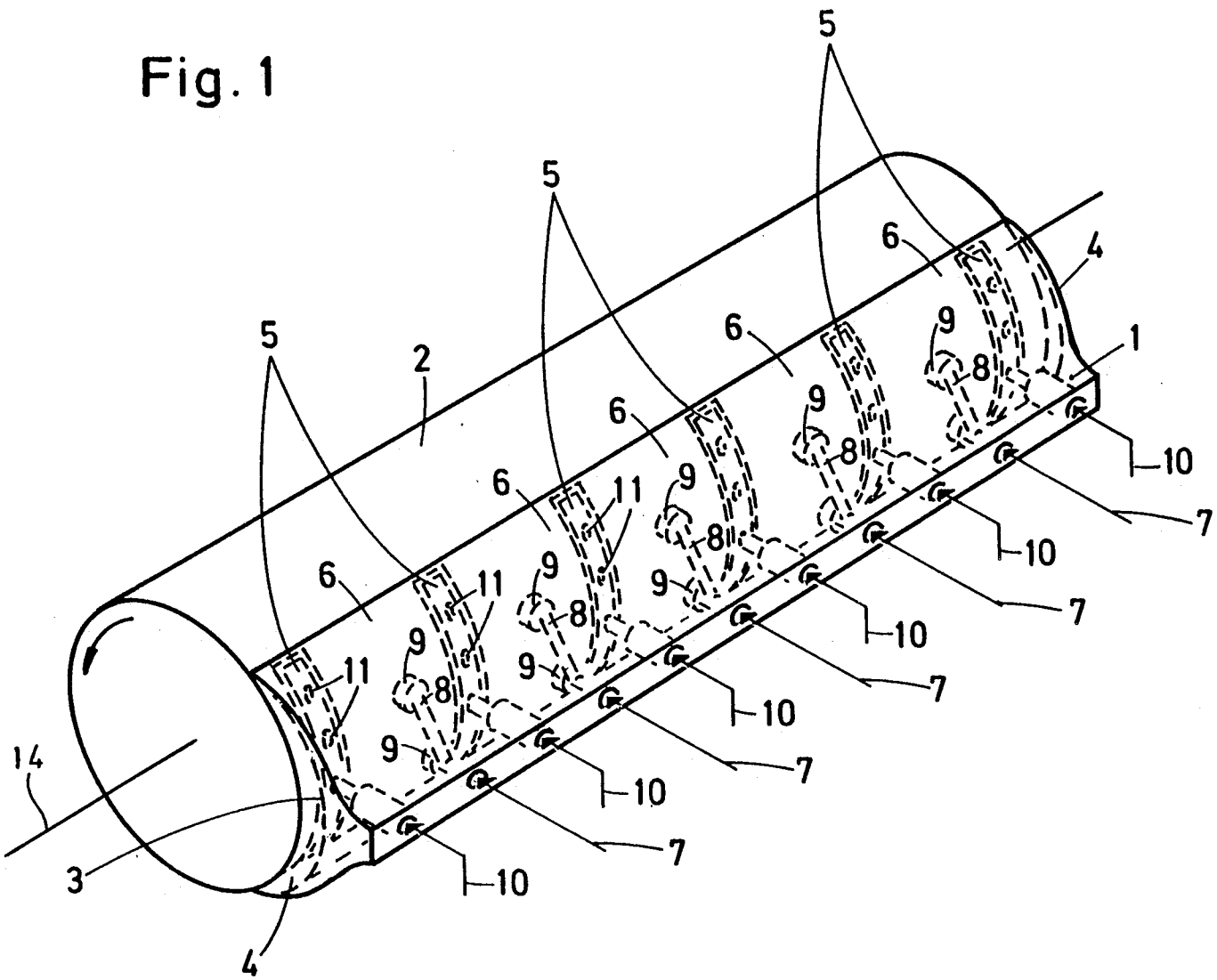
FIG. 1 is a perspective view of a supporting member according to our invention arranged on a working roll of a steel rolling mill.

As shown in FIG. 1 the apparatus for hydrostatic bracing of a roll of a rolling mill comprises a supporting member 1, which extends across the entire length of the roll 2. This supporting member 1 is mounted fixedly in a rolling mill stand which has not been shown in the drawing.

The supporting member is provided at its side turned toward the roll 2 with a shell-like cavity 3 of the supporting member 1 which has an elliptical segmental transverse cross section in this embodiment.

In this shell-like cavity 3, as indicated in the drawing by broken lines in FIG. 1, which extends over the entire length of the supporting member and which is closed to the exterior on its sides by opposing wall portions 4 contacting directly on the roll 2, a plurality of partitions 5, spaced along the roll axes from each other, are provided along the supporting member 1.

The partitions 5 divide the shell-like cavity into a plurality of pressurized chambers 6. A plurality of pressurized medium lines 7 are connected outside on the supporting member 1 through which a hydraulic pressurized medium is forced into the chambers 6 under a certain pressure through a plurality of ducts 8 and nozzles 9 provided in the supporting member 1.

Furthermore lines 10 are connected from the outside to the supporting member 1 to feed a liquid lubricant, such as oil or the like, into the region between the roll surface and the partitions. Advantageously a plurality of openings 11 are provided spaced from each other in the partitions 5 to uniformly distribute lubricant between the roll surface and the blocking pieces.

The available surface of the supporting member 1 is very advantageously utilized to nearly 100% of its capacity for support of the working roll 2 or some other mill roll, as shown in FIG. 1 for the supporting member 1 engaged on the roll 2.

Consequently, in comparison to the known supporting apparatus compared under equal working conditions, the device of the invention operates with only 70% energy consumption and pressure. The feed of pressurized medium to the pressurized chambers 6 is effected advantageously by valve-controlled pressurized medium supply lines 7, so that the pressing pressure in the individual chambers 6 can be varied and hence the pressure is optimized in the various zones along the roll 2 to matched the conditions. This is of particular significance especially in support of comparatively long working rolls with small diameters (200 mm and less).

Figure 2:
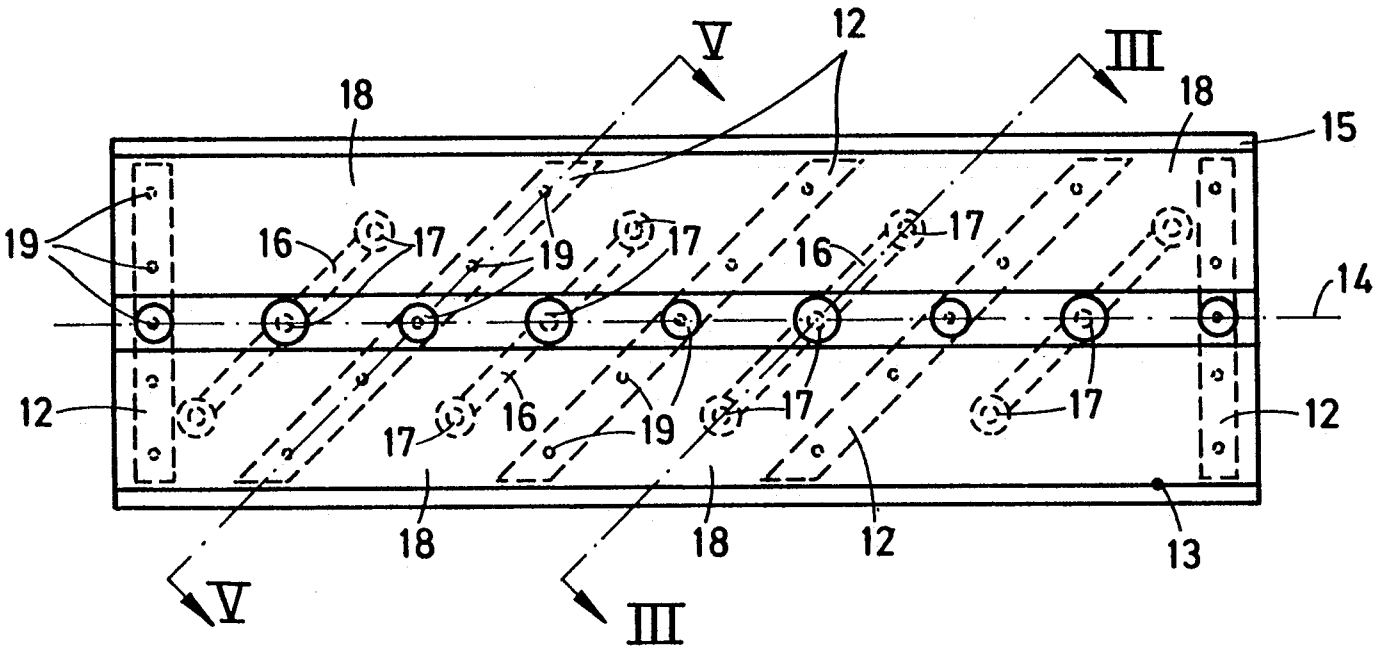
FIG. 2 is a top view of a supporting member arranged on a roll according to our invention with a plurality of inclined partitions and pressurized medium ducts.

As indicated in FIG. 2 the partitions 12 in the shell-like cavity of the supporting member 13 can very advantageously be oriented at an angle of about 45° to the longitudinal axis of the roll, and of course, so that as seen in the circumferential direction to the upper and lower ends of the partitions.

In this way the entire surface 15 of the roll is brought into contact with the pressurized medium in the supported region of the supporting member 13 in the same way as in FIG. 1 by pressurized medium supply lines, ducts 16 and nozzles 17 working together in harmony with the partitions 12 in the supporting member 13 oriented inclined to the longitudinal axis 14 of the working roll 2.

This inclined arrangement of the partitions 12 and the nozzles 17 in the supporting member 13 is characterized by a particularly good pressure distribution in the chambers 18 and protects the surface of the roll. Besides the lubricant feed is effected in the region between the partitions 12 and the surface of the rolls in the same way as in the supporting member shown in FIG. 1 and of course by corresponding openings 19 in the supporting member 13.

Figure 3:
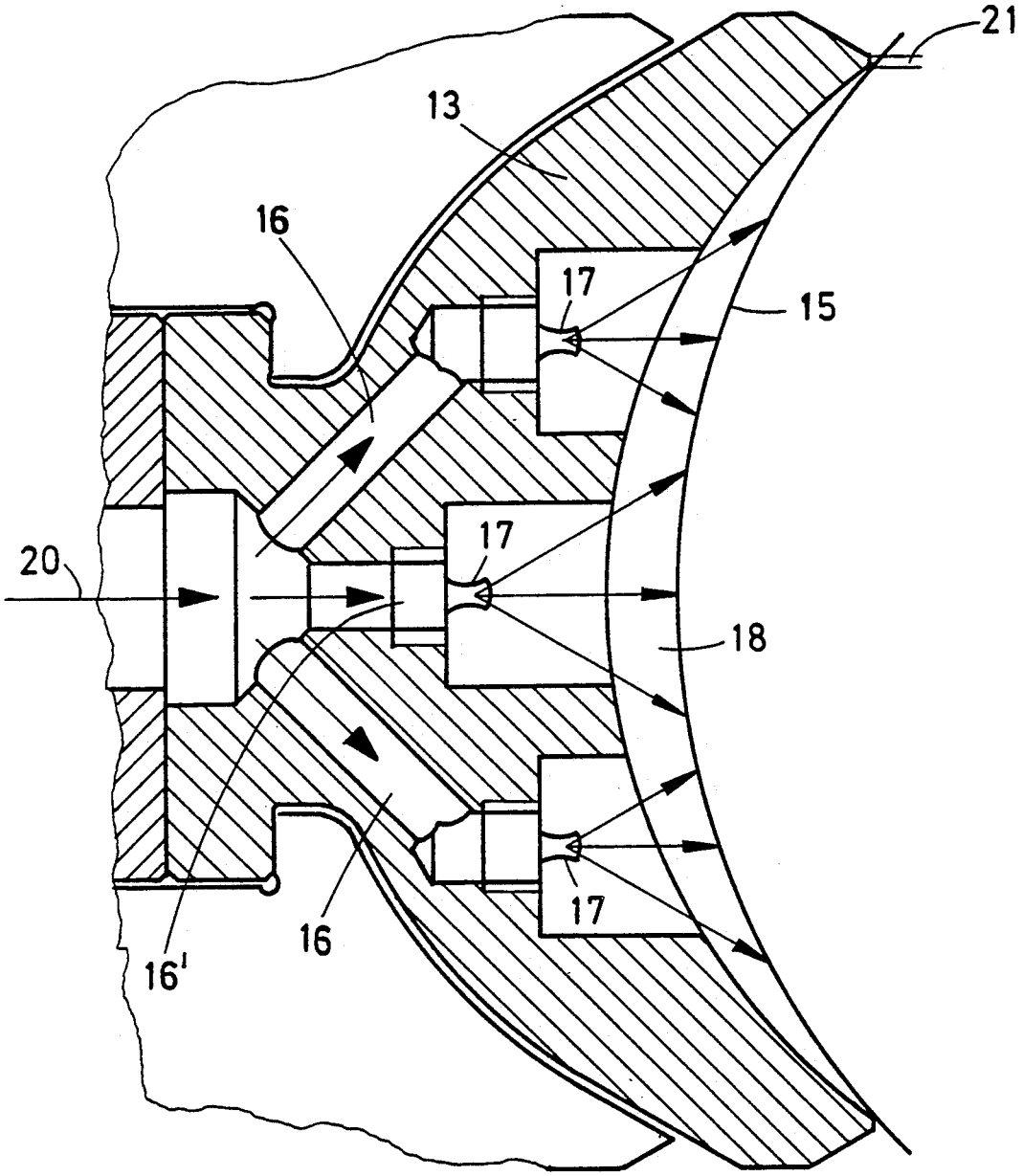
FIG. 3 is a detail transverse cross sectional view through the supporting member and the pressurized medium ducts along the line 3—3 of FIG.2.
Figure 4:
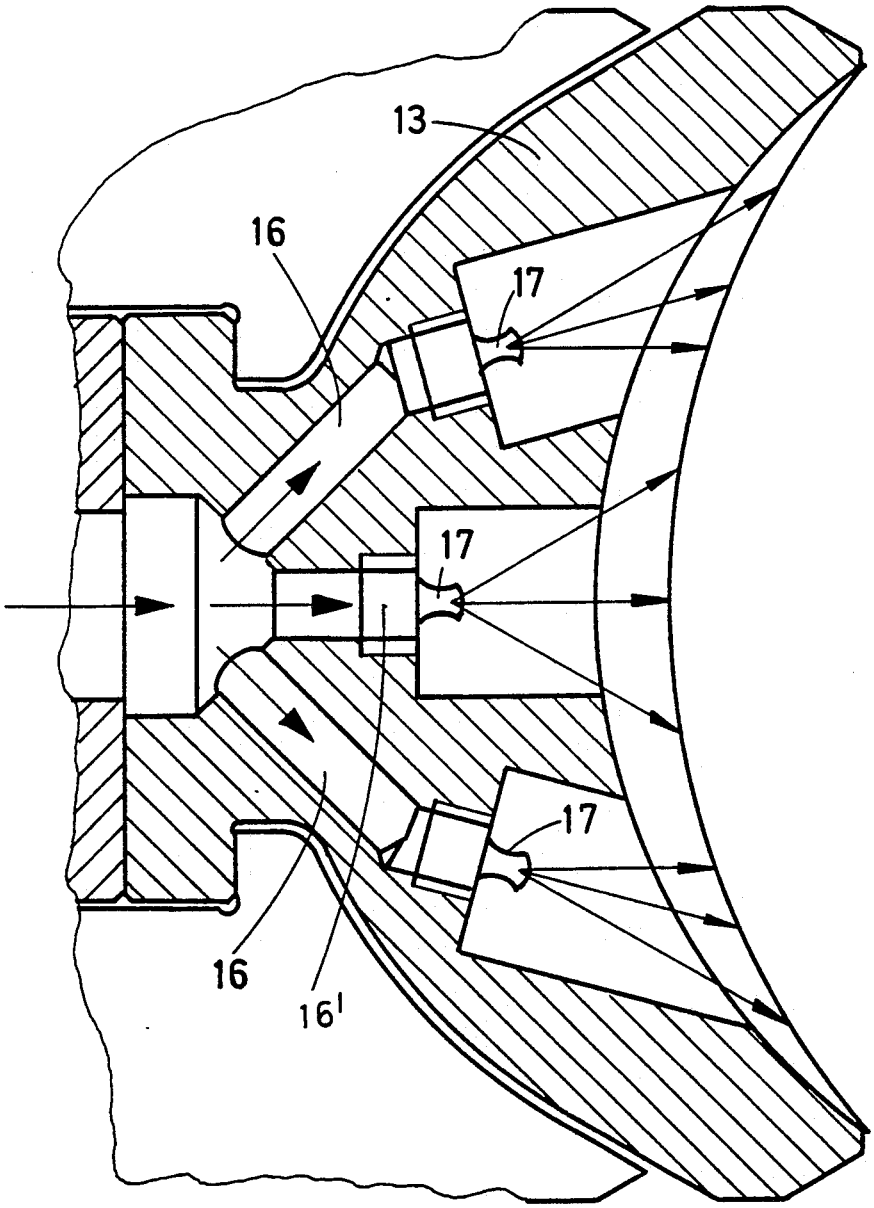
FIG. 4 is a detail cross sectional view through a supporting member according to our invention in a plane inclined to the longitudinal axis of the roll.

In supporting member 13 as indicated in the enlarged detail FIG. 3, three ducts 16, 16' (a center duct 16' and two outside ducts 16) with their nozzles 17 for the pressurized medium are provided in a plane in the chamber 18 so that the pressurized medium fed to the supporting member 13 from the outside in the direction of the arrow 20 arrives by the nozzle 1 indeed both in the central region and also in the edge regions of the crescent-shaped pressurized chamber 18. Thus a very uniform pressing pressure of the pressurized medium over the entire surface of the roll 15 is attained. A gap width 21 between the supporting member 13 and the roll body 15 is maintained appropriately between about 0.5 and 1.5 mm so that inaccuracies in manufacture are compensated and hydraulic centering features can be eliminated. Besides the supporting member is clamped with the frame of the rolling mill stand with the help of wedges or the like tightly so that it can be installed or dismounted or replaced very easily.

Figure 5:
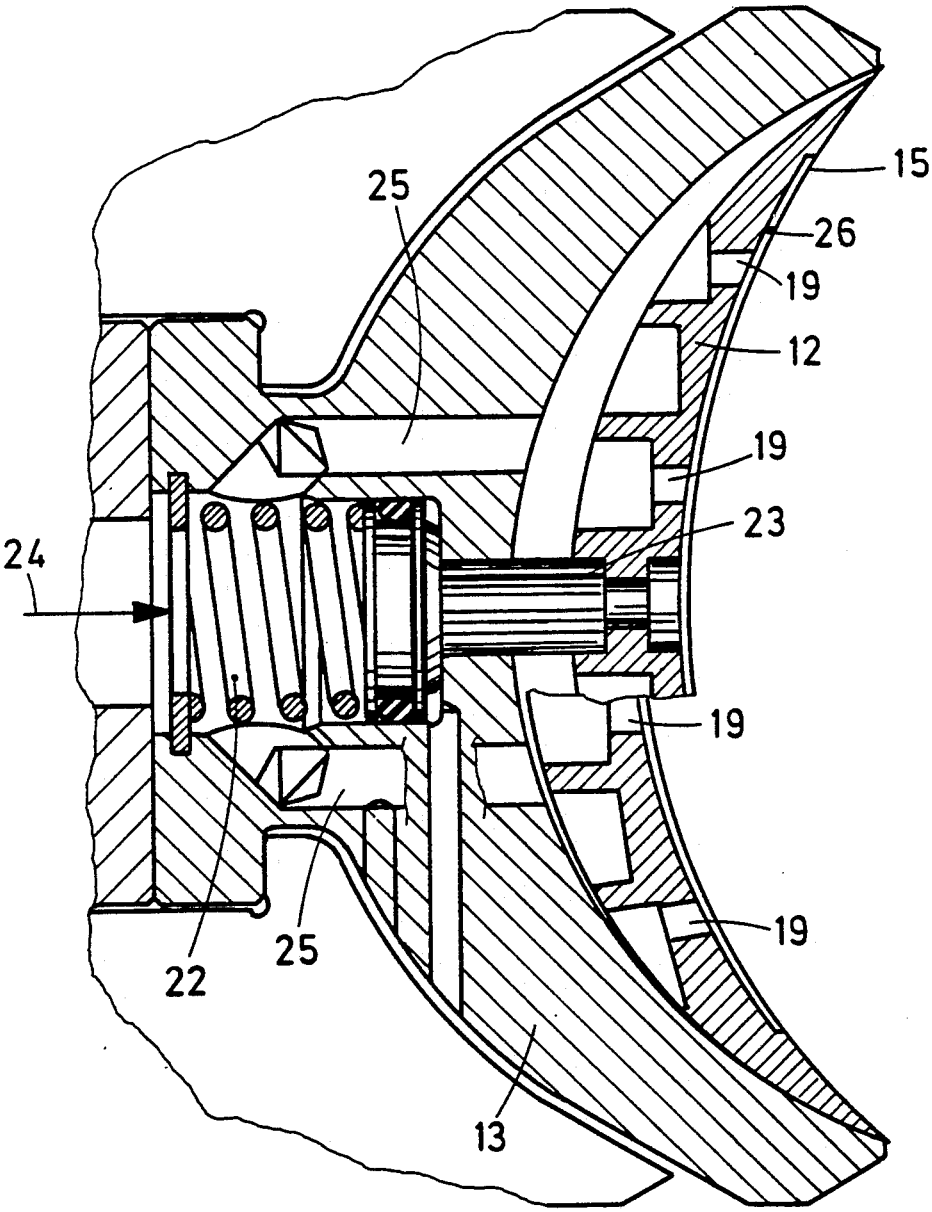
FIG. 5 is a detail cross sectional view taken along the line 5—5 through a blocking piece in the apparatus shown in FIG. 2.

As shown further in a detailed cross sectional view through the crescent-shaped partitions 12 according to FIG. 5, the partition 12 is pressed against the surface 15 of the roll 1 and held fast against it with the help of a coil or compression spring 22.

The lubricant is supplied under high pressure by a tube not shown in the drawing in the direction of the arrow 24 in the duct 25 located in the supporting member 13, from where it arrives n the pocket-like cavity 26 in the partitions 12 facing the surface of the roll through the openings 19.

Since the partitions 12 according to our invention are made from an elastic material, particularly plastic, and the lubricant is fed under high pressure between the surface of the roll and the partitions, the friction in the region of the blocking pieces is kept to a minimum. The service life of the blocking pieces 12, which if necessary can be replaced very easily and can be thus made new, is comparatively long.

The features according to our invention are not limited to the embodiments shown in the drawing. Thus for example, within the scope of our invention, the partitions can be oriented at any of a variety of angular orientations and in any arbitrary geometric orientation, especially one over the other.

We claim:

1. An apparatus for support of a roll in a rolling mill comprising:

a single supporting member extending over the entire length of said roll having a shell-like cavity adjacent and facing said roll;

a plurality of partitions spaced from each other transversely along said supporting member in said shell-like cavity to divide said shell-like cavity into a plurality of pressurized chambers; and respective pressurized medium lines connected to said chambers for individually pressurizing same, said partitions being crescent-shaped and are made from an elastic material.

2. The apparatus defined in claim 1 wherein said elastic material comprises a plastic.

3. The apparatus defined in claim 1 wherein said partitions are provided with a plurality of openings for feeding a lubricant between a surface of said roll and said blocking pieces.

4. An apparatus for support of a roll in a rolling mill comprising:

a single supporting member extending over the entire length of said roll having a shell-like cavity adjacent and facing said roll;

a plurality of partitions spaced from each other transversely along said supporting member in said shell-like cavity to divide said shell-like cavity into a plurality of pressurized chambers; and respective pressurized medium lines connected to said chambers for individually pressurizing same each of said partitions being connected with a compression spring, each of said partitions in said shell-like cavity of said supporting member being oriented at an angle of about 45° inclined to the longitudinal axis of said roll, said supporting member having a plurality of ducts connected to said pressurized medium lines, which open into said pressurized chambers.

5. The apparatus defined in claim 4 wherein a center one of said ducts and two outer ones of said ducts, each provided with a nozzle, are arranged in a plane in said supporting member for feeding said pressurized medium, said center duct being oriented substantially perpendicular to a surface of said roll and both of said outer ducts being inclined toward to said surface of said roll.

6. An apparatus for support of a roll in a rolling mill comprising:

a supporting member having a longitudinally-extending elliptically-cross sectioned shell-like cavity extending over the entire length of said roll and engaging said roll so that roll rests in said shell-like cavity; and a plurality of crescent-shaped plastic partitions spaced from each other transversely along said supporting ember in said shell-like cavity to divide said shell-like cavity into a plurality of pressurized chambers, to which a plurality of pressurized medium lines are connected, each of said partitions being provided with a plurality of openings for a lubricant and with a compression spring to urge said blocking piece toward said roll.

* * * * *